United States Patent [19]

Paterson et al.

[11] 4,210,527

[45] Jul. 1, 1980

[54] TWIN AIR CLASSIFIER SYSTEM

[75] Inventors: Malcolm M. Paterson, Lee, N.H.; William J. Paxson, Cedar Rapids; Stewart B. Olson, SE. Cedar Rapids, both of Iowa

[73] Assignee: Raytheon Company, Lexington, Mass.

[21] Appl. No.: 29,169

[22] Filed: Apr. 12, 1979

[51] Int. Cl.[2] ..... B07B 4/06

[52] U.S. Cl. ..... 209/152; 209/147; 209/154; 55/415; 198/366

[58] Field of Search ..... 209/152, 139 R, 136–138, 209/154, 146, 147, 473; 198/366, 372; 55/410, 413–415

[56] References Cited

U.S. PATENT DOCUMENTS

| | | | |
|---|---|---|---|
| 827,213 | 7/1906 | Comstock | 209/138 |
| 3,620,369 | 11/1971 | Steen et al. | 209/3 |

FOREIGN PATENT DOCUMENTS

| | | | |
|---|---|---|---|
| 2311598 | 12/1976 | France | 209/12 |
| 1917 | of 1881 | United Kingdom | 209/154 |

*Primary Examiner*—Ralph J. Hill

*Attorney, Agent, or Firm*—John T. Meaney; Joseph D. Pannone

[57] ABSTRACT

An air classifier system which embodies two rotary drum classifiers, each with an individual adjustable plenum, the drums being individually angled at selected inclinations and the plenum capacities being variable, so that two separate masses of commingled materials such as municipal refuse and oversize bulky waste, for example, may be simultaneously classified and will produce a combined single output of refuse derived fuel.

11 Claims, 9 Drawing Figures

FIG. 3
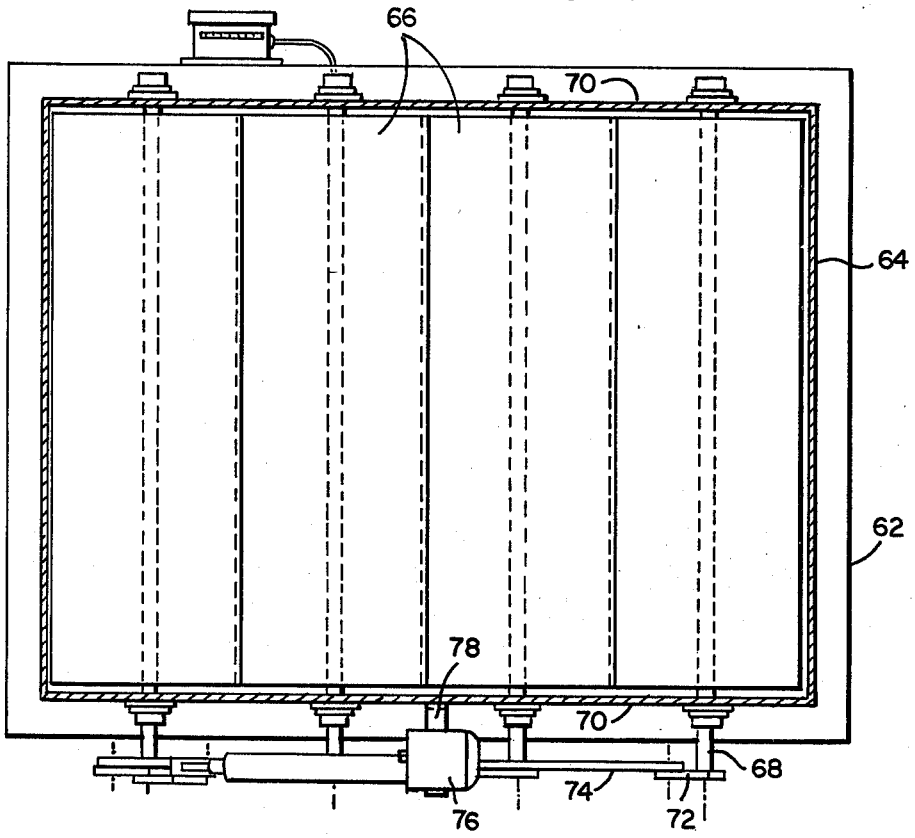
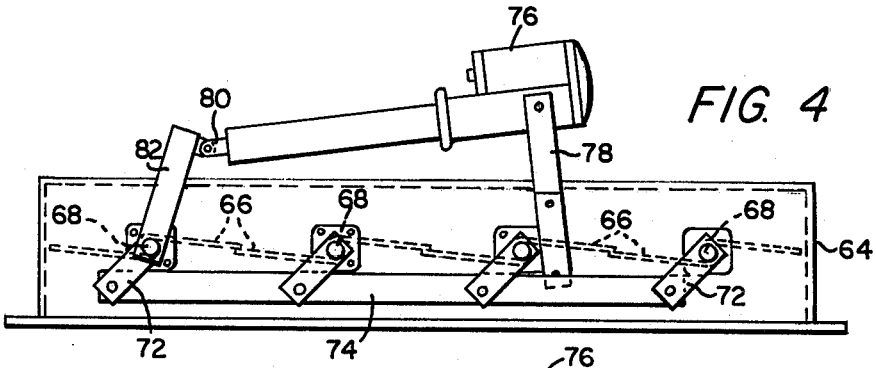
FIG. 4
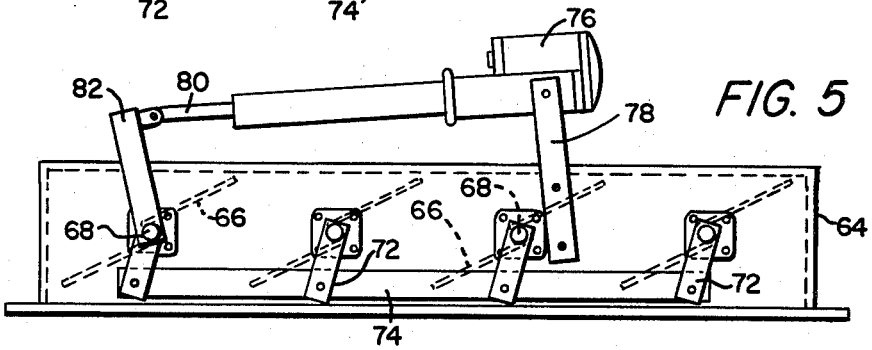
FIG. 5

TWIN AIR CLASSIFIER SYSTEM

BACKGROUND OF THE INVENTION

Air classifier systems are commonly used to produce serviceable materials for use as fuels or to recover valuable resources from municipal refuse and the like. It has been found that an inclined rotary drum coupled with a plenum will efficiently separate light and heavy items from a supply of commingled materials if the drum is inclined at an optimum angle and if air through the system flows at an optimum rate of speed, and if certain other parameters are optimized.

Gibbons and Passanti in their U.S. Pat. No. 3,804,249 teach the use of a large rotating drum with its axis inclined to the horizontal with a blower for creating flow of air through the drum and upwardly through a plenum at the upper end of the drum. Commingled materials are introduced into the rotating drum and are tumbled continuously by the drum. Heavy items gravitate toward and out the lower end of the drum while light items are propelled by the air stream out the upper end of the drum into the plenum. Within the plenum the light materials drop to the bottom while the air is exhausted above.

Since the Gibbons et al development, however, air classifier systems have become much more exotic and include various components and modules which are intended to improve aspects of the classification and dust removal operations. One such improved system is disclosed in copending U.S. patent application Ser. No. 906,726, (now abandoned) filed May 17, 1978 by Malcolm M. Paterson and assigned to the same assignee as the present invention. However, practically no means has been found to satisfactorily increase the capacity of air classification system of this type or to classify simultaneously two materials having different densities or similar different characteristics. Prior to this invention it has been necessary to first classify one supply of material and then later to classify the second material, or to provide two separate complete systems, one for each material.

SUMMARY OF THE INVENTION

The above and other disadvantages of the prior art are overcome in the present invention by the provision of a pair of rotary drums which are disposed to dispense light materials for refuse-derived fuel into a single adjustable plenum. The angle of inclination of each drum is adjustable independently so that materials of different characteristics may be classified in each drum simultaneously. The light materials from both drums will be dispensed into the single plenum for subsequent removal as refuse-derived fuel.

The plenum contains two chambers opposite the upper ends of the respective drums, and each chamber is variable in size so as to control the rate at which the air stream flows, which rate may be adjusted in accordance with the particular characteristics of the materials being separated in the respective drums. For example, with a mixture of materials comprising predominantly oversize bulky waste, the drum must be inclined sharply at an angle such as 18°, for example, for proper separation of light and heavy materials. The plenum chamber opposite the end of this drum must be restricted so as to increase the rate of flow of the air stream passing through it. With a mixture of materials comprising the usual municipal waste, the drum need not be angled as steeply and may be inclined at an angle of 9°–10°, for example, and the associated plenum chamber will not be restricted.

With an arrangement of this type, refuse-derived fuel material may be obtained simultaneously from two quite different types of raw materials.

Either drum and associated plenum chamber may be operated by itself when minimum quantities of materials are received for classification, or both may be operated simultaneously for classification of large quantities of a single mixture of materials, if desired.

The air stream velocity through the plenum chambers can be still further controlled by a stepped-solenoid controlled baffle arrangement located at the top of each chamber.

BRIEF DESCRIPTION OF THE DRAWINGS

The above and other advantages of this invention will become apparent from the following description taken in connection with the accompanying drawings, wherein:

FIG. 3 is a sectional view of the air velocity control device taken substantially on line 3—3 of FIG. 1 looking in the direction of the arrows;

FIG. 4 is a side elevational view of the control device showing the baffles closed;

FIG. 5 is a view similar to FIG. 4 showing the baffles open;

DESCRIPTION OF THE PREFERRED EMBODIMENTS

Figure 1:
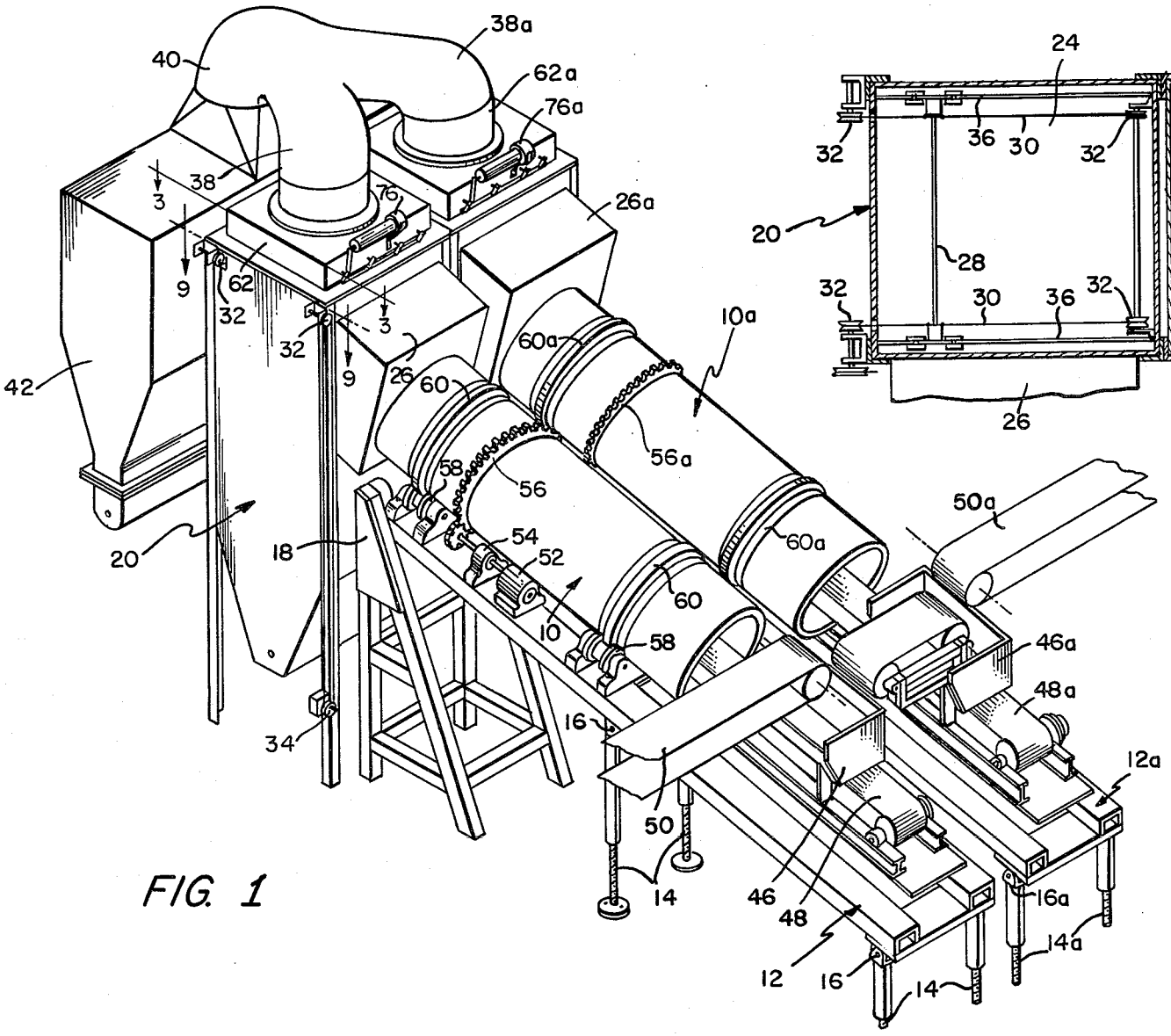
FIG. 1 is an isometric view of an air classifier system embodying the invention.
Figure 2:
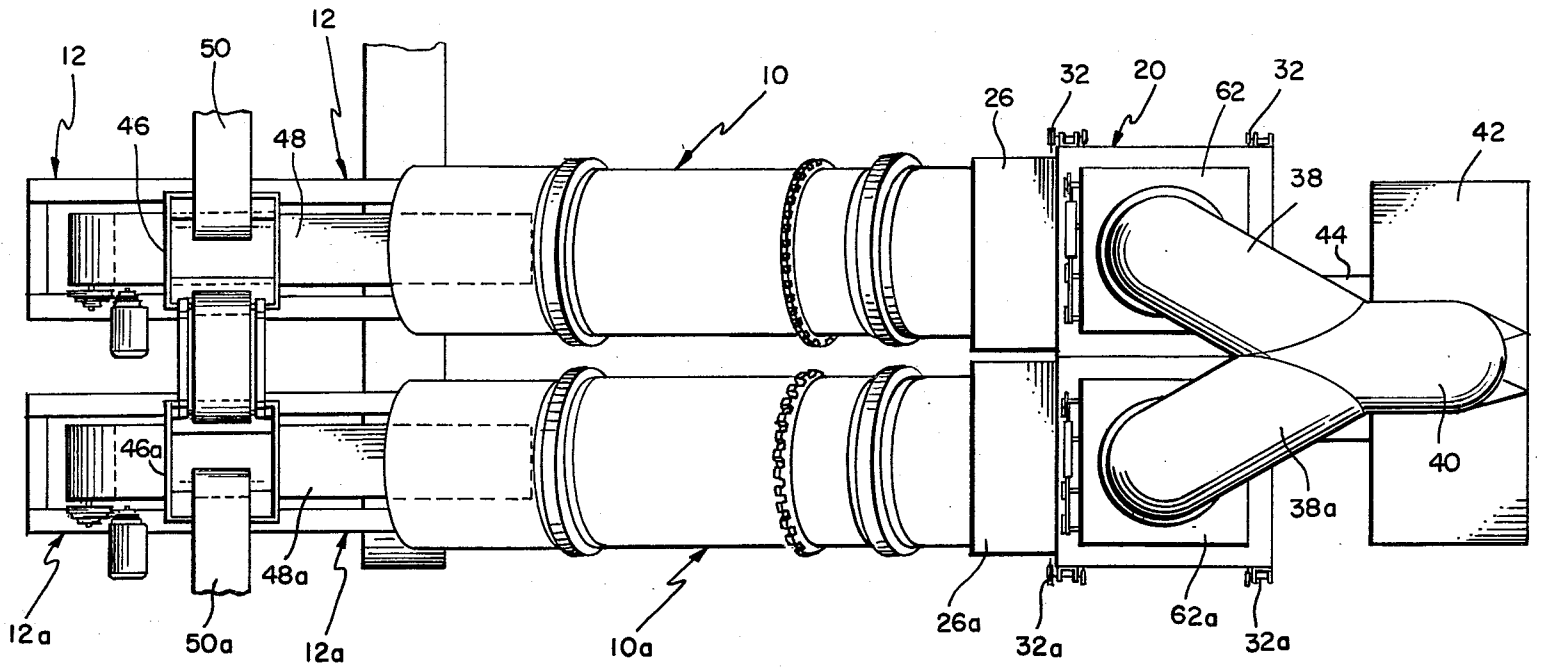
FIG. 2 is top plan view of the system shown in FIG. 1.

Referring more particularly to the drawings wherein like characters of reference designate like parts throughout the several views, there is shown in FIGS. 1 and 2 the active processing portions of an air classifier system embodying the present invention. The air classifier system includes two separate rotary drum classifiers 10 and 10*a* each of which is suitably mounted on a respective platform 12 and 12*a*. The platforms are disposed substantially parallel so that the drums are located in spaced side-by-side relation.

The platforms are individually vertically adjustable to a selected angle of inclination whereupon the axes of the drums are also individually adjusted to a desired angle of inclination. Such adjustment of the platforms may be accomplished by means of threaded or telescopic jackposts 14 and 14*a*, for example, which are suitably mounted beneath the platforms 12 and 12*a* and attached at their upper ends to the platforms by clevis devices 16 and 16*a*.

The upper ends of the inclined platforms 12 and 12*a* are pivotally mounted on upper end portions of fixed supports or standards 18 (shown only in FIG. 1). Thus, a platform 12 or 12*a* can be raised or lowered by manipulation of respective posts 14 or 14*a*, causing the longitudinal axis of the associated drum 10 or 10*a* to be angled about the axis of the pivotal connection to support 18. It will be apparent that such angular adjustment produces the least movement at the upper end of the inclined drum while its lower end traverses the greater distance.

Figure 9:
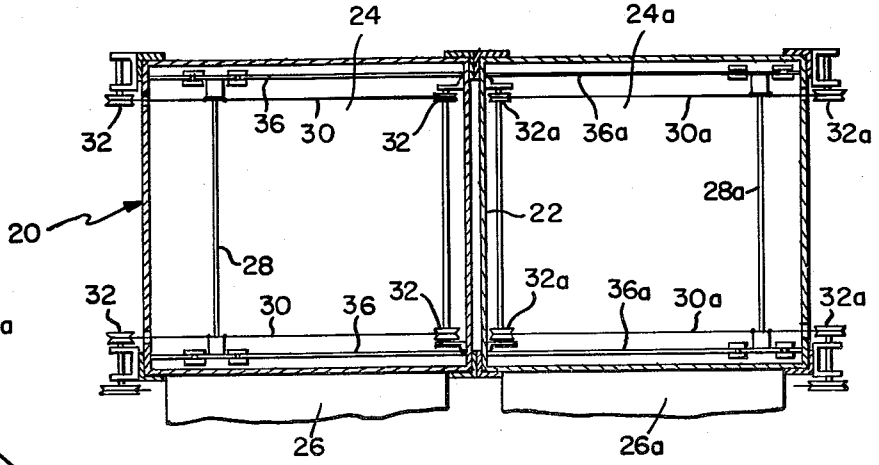
FIG. 9 is a sectional view taken substantially along line 9—9 of FIG. 1 looking in the direction of the arrows.

At the upper end of the drum-platform structures is a collector or plenum 20 which is separated by a partition 22 (FIG. 9) into two separate chambers 24 and 24*a*. Partition 22 extends down from the top of the plenum 20 with its lower end terminating well above the bottom of the plenum so that there is provided a single compartment which is shared by both chambers 24 and 24*a* at the bottom of the plenum. Means such as a screw conveyor (not shown) is provided in the extreme lower end of the plenum for removing material deposited therein, as will be described.

The two drums 10 and 10*a* communciate at their upper ends with the respect chambers 24 and 24*a* through air seals 26 and 26*a* which are designed to allow tilting movement of the upper ends of the drums without escape of substantial amounts of air. Such an air seal is shown and described in U.S. Pat. No. 4,052,797, Christensen, assigned to the same assignee as the present invention.

The volume of each chamber 24 and 24*a* can be varied by a vertically extending movable baffle or partition 28 and 28*a* respectively for reasons to be fully explained hereinafter. Movement of the baffles may be accomplished by any suitable manual, mechanical or electrical means shown in FIGS. 1 and 2 as being cables 30 and 30*a* which are attached to the respective baffles 28 and 28*a*, and which ride in pulleys 32 and 32*a*. Cables 30 and 30*a* are connected outside the plenum to hand cranks 34 by which the baffles 28 and 28*a* may be moved along tracks 36 and 36*a* on which they are suspended.

At the upper end of the plenum 20 are two exhaust ducts 38 and 38*a* which communicate with respective chambers 24 and 24*a*. Ducts 38 and 38*a* merge into a single duct 40 which is connected to the top of a dust collector 42. The dust collector 42 is provided with an internal filtering system (not shown) which extracts dustlike particles from an air stream passing through it as is fully disclosed in copending application Ser. No. 906,726, filed May 17, 1978 by Malcolm M. Paterson and assigned to the same assignee as the present invention.

A blower system 44 is operatively connected with the dust collector 42 and may be located in any convenient position such as, for example, between the plenum 20 and dust collector 42 as shown in FIG. 2. The blower 44 creates a stream of air at a predetermined velocity which flows through the drums 10 and 10*a* into the respective chambers 24 and 24*a* of plenum 20, upwardly through the chambers and out the plenum through ducts 38 and 38*a* and through duct 40 into the dust collector 42, and eventually out the dust collector 42 through the blower 44.

In accordance with this invention, adjacent the lower end of each drum 10 and 10*a* is a respective hopper 46 and 46*a*, each of which overlies a respective conveyor or slinger 48 and 48*a* which extends into the adjacent drum. Slingers 48 and 48*a* may be operated by motor driven pulleys 49 and 49*a* respectively. A pair of feed conveyors 50 and 50*a* is disposed to supply materials to the respective hoppers 46 and 46*a*.

In the following description of the operation of an air classifier system, reference will be made first to the details relating to only drum 10. However, it will be understood that drum 10*a* will operate and function similarly.

To classify a supply of commingled materials such as municipal waste, for example, with the intention to separate out refuse derived fuel materials, the drum 10 is made to rotate. Such rotation may be accomplished by means of a motor 52 which, through suitable reduction gearing 54, drives a sprocket wheel 56 which is fixed to and extends circumferentially around the drum 10 at a point midway of its length. Longitudinal displacement of the drum is prevented by roller devices 58 and flanges 60 as is well known.

The drum 10 will be adjusted to the selected angle of inclination depending upon the characteristics of the materials being classified. Then the blower 44 is operated to produce an air stream through the apparatus as previously described, and the baffle 28 in chamber 24 will be positioned to create a chamber 24 of a size which produces the desired velocity in the air stream passing upwardly through the chamber 24.

If desired, additional means 62 may be used to more critically control the velocity of the air passing through the chamber 24. Such means 62 is mounted on the top of the plenum 20 between chamber 24 and duct 38, and comprises a casing 64 containing a number of baffles 66 which are each fixed along one edge to rods on shafts 68 which are rotatably mounted in side walls 70 of the casing 64. One end of each of the rods 70 projects through the casing wall and has one end of a link 72 fixed to it. The opposite ends of the links 72 are pivotally attached at spaced intervals to an operating bar 74 by which motion is imparted simultaneously to all links 72 and, consequently, to the rods 68 and baffles 66.

The baffles 66 are shown closed in FIGS. 3 and 4; that is, the rods 68 have been rotated by links 72 and bar 74 to an extent where the edges of the baffles 66 overlap one another, thus providing an effective barrier to flow of air upwardly through the casing 64.

The baffles 66 must be opened to permit controlled air flow and this is done by a solenoid 76 which is mounted on the casing as by bracket 78, its plunger 80 being connected to one end of an arm 82 which is fixed at its other end to one of the rods 68. Thus, operation of solenoid 76 will cause rotation of said arm 68 and, through bar 74 and links 72, will rotate all rods 68 and move the baffles 66 into spaced relation as shown in FIG. 5.

Materials to be classified are deposited by feed conveyor 50 into hopper 46. From the hopper the materials are deposited by slinger 48 into the interior of drum 10. These materials will be continuously lifted and dropped within the drum by its rotation and in this way the heavier items will gradually work their way downwardly toward and out the lower end of the drum. The light items, which are usually suitable as refuse-derived fuel, will be entrained within the air stream and will be carried into the chamber 24. Within chamber 24 the air stream is diverted sharply upward, and in doing so will drop the light items to the bottom of the plenum for subsequent removal as refuse-derived fuel. It will be apparent that by varying the volume of chamber 24 by adjustment of partition 28 and/or by adjusting the baffles 66 in air control device 62 the velocity of the flow of rising air in the plenum may be critically controlled so as to most efficiently separate the light items from the air stream.

The air stream, preferably containing only dustlike particles, will then be drawn through the dust collector 42 for filtering.

It will be apparent that the second classifier section, including drum 10*a*, conveyor 50*a* and chamber 24*a*, may operate simultaneous with the first classifier section or independently thereof. Similar materials may be classified by both sections, in which case the angle of inclination of the drum 10*a* and the baffling of the chamber 24*a* will be similar to that in the first section. However, if the materials being classified by the drum 10*a* have different density and other characteristics from the materials being classified by the first section, then the drum 10*a* must be angled differently and the baffling must also be altered. In any case, the refuse-derived fuel components in both materials will be deposited in the bottom of the plenum.

Figure 6:
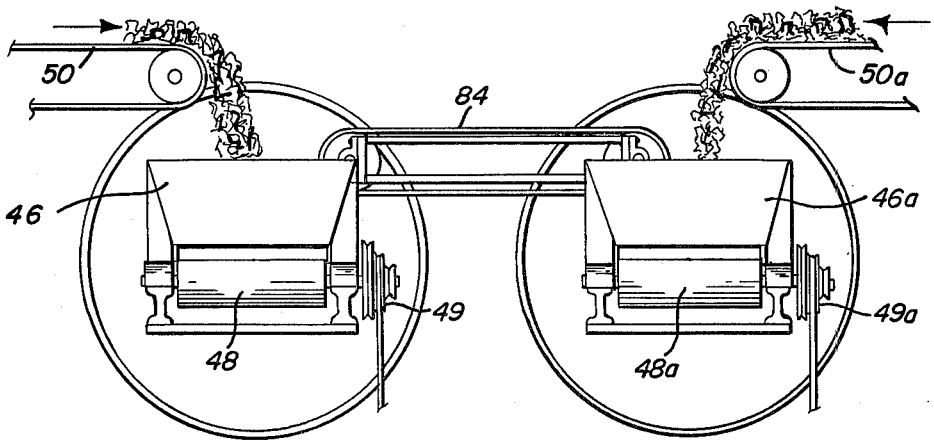
FIGS. 6, 7 and 8 are diagrammatic views illustrating various methods of feeding materials to the air classifier drums.

FIG. 6 illustrates the processing of materials by both classifier sections simultaneously. Feed conveyors 50 and 50*a* will both supply materials, which may be the same or may be different, to the respective hoppers 46 and 46*a* for deposit in the drums by slingers 48 and 48*a*.

Figure 7:
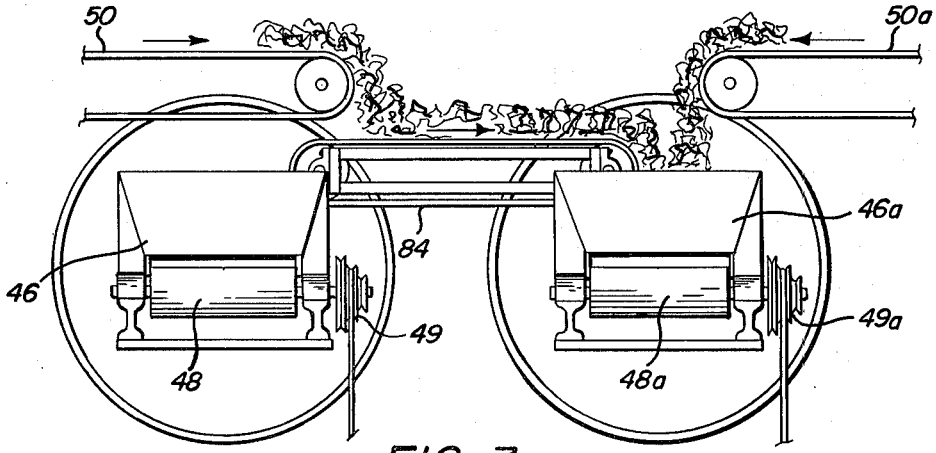

FIG. 7 illustrates the case where both feed conveyors 50 and 50*a* are being utilized to feed only the second drum 10*a* through hopper 46*a* and slinger 48*a*. To accomplish this, a short reversible conveyor 84 is disposed transversely between the hoppers 46 and 46*a* as shown, the opposite ends of this conveyor being disposed to discharge into the respective hoppers. When it is desired that feed conveyors 50 and 50*a* both be utilized to feed only hopper 46*a*, the conveyor 50 will be moved so as discharge onto transverse conveyor 84 which is being operated by a suitable motor (not shown) to discharge directly into hopper 46*a* along with feed conveyor 50*a*.

Figure 8:
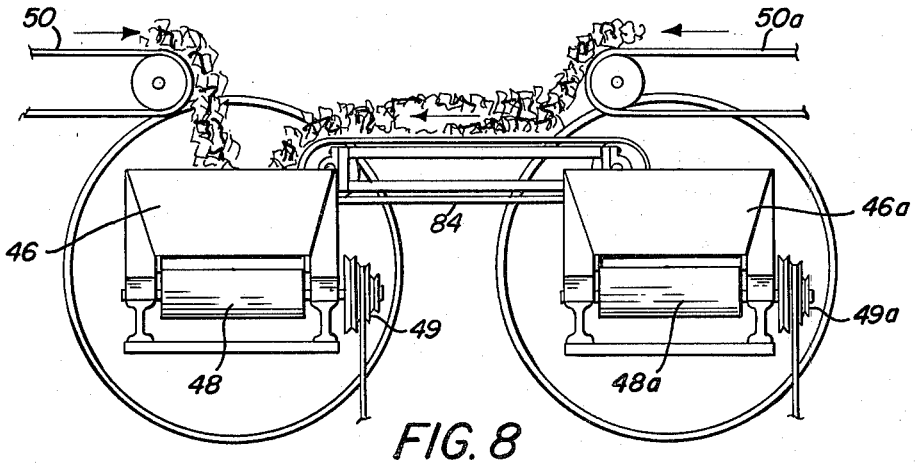

However, when only drum 10 is to be fed simultaneously by both feed conveyors 50 and 50*a*, the transverse conveyor 84 will be operated in the direction which will discharge into hopper 46, shown in FIG. 8. Feed conveyor 50*a* will in this case be extended to discharge onto the transverse conveyor 84, and then both the transverse conveyor 84 and feed conveyor 50 will both discharge into hopper 46 so that slinger 48 will supply the materials to drum 10.

From the foregoing it will be apparent that all of the objectives of this invention have been achieved in the apparatus shown and described. It will also be apparent, however, that various modifications and changes in the structures shown and described may be made by those skilled in the art without departing from the spirit of the invention as expressed in the accompanying claims. Therefore, all matter shown and described is to be interpreted as illustrative and not in a limiting sense.

What is claimed is:

1. Resource recovery apparatus comprising the combination of a plenum having two separate materials-receiving chambers in its upper region and a materials-collection chamber in its lower region in direct communication with both of said receiving chambers, a pair of inclined rotary drum classifiers having their upper ends operatively connected with respective receiving chambers, and means for creating air streams through the drums and the respective receiving chambers, said drums being rotatable whereby materials deposited in the drums will be separated therein into heavy components which exit from the lower ends of the drums and light components which are removed by the air streams into the respective receiving compartments and deposited in the common collection chamber.

2. Apparatus as set forth in claim 1 wherein means is provided for individually adjusting the angle of inclination of the respective drums in accordance with known characteristics of the materials being classified.

3. Apparatus as set forth in claim 1 wherein means is provided for varying the velocity of the air streams flowing through the respective receiving chambers.

4. Apparatus as set forth in claim 1 wherein means is provided for removing dustlike particles from the air streams flowing through the receiving chambers.

5. Apparatus as set forth in claim 1 wherein conveyor means is provided for supplying different materials to the respective drums simultaneously.

6. Apparatus as set forth in claim 1 wherein conveyor means is provided for supplying similar materials to one drum or simultaneously to both drums.

7. Resource recovery apparatus comprising the combination of a plenum having two separate materials-receiving chambers in its upper region and a materials-collection chamber in its lower region in direct communication with both of said receiving chambers, a pair of inclined rotary drum classifiers having their upper ends operatively connected with respective receiving chambers, means for creating air streams through the drums and the respective receiving chambers, said drums being rotatable whereby materials deposited in the drums will be separated therein into heavy components which exit from the lower ends of the drums and light components which are removed by the air streams into the respective receiving compartments and deposited in the common collection chamber, a fixed partition separating said receiving chambers, and baffles vertically disposed within respective chambers and individually movable to vary the effective volumes of the respective receiving chambers and to thereby control the removal of said light components from the air streams.

8. Resource recovery apparatus comprising the combination of a plenum having two separate materials-receiving chambers in its upper region and a materials-collection chamber in its lower region in direct communication with both of said receiving chambers, a pair of inclined rotary drum classifiers having their upper ends operatively connected with respective receiving chambers, and blower means for creating air streams through the drums the respective receiving chambers, said drums being rotatable whereby materials deposited in the drums will be separated therein into heavy components which exit from the lower ends of the drums and light components which are removed by the air streams into the respective receiving compartments and deposited in the common collection chamber, said receiving chambers each having an opening at its upper end for exhaust of the air streams flowing therethrough, and air flow control means over each of said openings for individually varying the velocity of the air streams passing through said openings and to thereby control the removal of said light components from the air streams.

9. Apparatus as set forth in claim 8 wherein said air flow control means each comprises a frame, rotatable baffles in said frame movable into and out of closing relation to the adjacent opening, and operating means for adjusting said baffles to restrict air flow from said adjacent opening.

10. Apparatus as set forth in claim 9 wherein said operating means is a solenoid operatively connected to said baffles.

11. Resource recovery apparatus comprising the combination of a plenum having two separate materials-receiving chambers in its upper region and a materials-collection chamber in its lower region in direct communication with both of said receiving chambers, a pair of inclined rotary drum classifiers having their upper ends operatively connected with respective receiving chambers, blower means for creating air streams through the drums and the respective receiving chambers, said drums being individually rotatable about their longitudinal axes and being disposed in substantially parallel ralation with their upper ends connected with a common side of said plenum, a pair of hoppers disposed adjacent the lower end of respective drums, a slinger operatively connected with each hopper for dispensing materials from the hoppers into respective drums, a transversely disposed reversible conveyor between said hoppers and having its ends disposed to discharge selectively into the respective hoppers, and load conveyors for each respective hopper, said load conveyors being disposed to discharge into the respective hoppers or selectively onto said transverse conveyor.

* * * * *